US009117648B2

(12) United States Patent
Pothoven et al.

(10) Patent No.: US 9,117,648 B2
(45) Date of Patent: Aug. 25, 2015

(54) METHOD OF APPLYING A FARADAY CAGE ONTO THE RESONATOR OF A MICROWAVE LIGHT SOURCE

(75) Inventors: Floyd Pothoven, Lakewood, CA (US); Andrew Simon Neate, Fairford Leys (GB)

(73) Assignee: Ceravision Limited, Milton Keynes (GB)

( * ) Notice: Subject to any disclaimer, the term of this patent is extended or adjusted under 35 U.S.C. 154(b) by 225 days.

(21) Appl. No.: 13/578,132

(22) PCT Filed: Feb. 8, 2011

(86) PCT No.: PCT/GB2011/000163

§ 371 (c)(1),
(2), (4) Date: Nov. 5, 2012

(87) PCT Pub. No.: WO2011/098753

PCT Pub. Date: Aug. 18, 2011

(65) Prior Publication Data

US 2013/0052904 A1 Feb. 28, 2013

Related U.S. Application Data

(60) Provisional application No. 61/323,987, filed on Apr. 14, 2010.

(30) Foreign Application Priority Data

Feb. 10, 2010 (GB) ..... 1002283.8

(51) Int. Cl.
*H01J 9/00* (2006.01)
*H01J 65/04* (2006.01)

(52) U.S. Cl.
CPC ..... *H01J 65/044* (2013.01)

(58) Field of Classification Search
CPC ..... H01J 65/044
USPC ..... 445/22, 26–27, 58; 313/567, 231.71, 313/231.61, 325, 634–635, 313, 607; 315/34, 111.21, 248, 39; 333/208, 202
See application file for complete search history.

(56) References Cited

U.S. PATENT DOCUMENTS 4,707,632 A 11/1987 Walsh
5,334,913 A 8/1994 Ury (Continued)

FOREIGN PATENT DOCUMENTS

WO 2007/126899 A2 11/2007
WO 2009/063205 A2 5/2009

*Primary Examiner* — Anne Hines
*Assistant Examiner* — Jose M Diaz
(74) *Attorney, Agent, or Firm* — Bay State IP, LLC

(57) ABSTRACT

A method of applying a Faraday cage to a lucent resonator, the resonator having a void containing microwave-excitable material and being adapted for microwave resonance in the resonator and within the Faraday cage for driving a light emitting plasma in the void, the method consisting in the steps of: deposition of a conductive material onto the lucent resonator; applying, patterning and developing a photoresist material over the conductive material to leave the conductive material exposed where it is not required; removing the conductive material where not required and the photoresist material from the required conductive material, leaving a reticular network of conductive material providing a Faraday cage and depositing a layer of protective material over the cage of conductive material.

8 Claims, 2 Drawing Sheets

(56) References Cited

U.S. PATENT DOCUMENTS

| | | | | |
|---|---|---|---|---|
| 8,089,203 | B2 * | 1/2012 | Neate | 313/160 |
| 2002/0030453 | A1 | 3/2002 | Kirkpatrick | |
| 2007/0040500 | A1 * | 2/2007 | Fukuda et al. | 313/512 |
| 2011/0221326 | A1 * | 9/2011 | Preston | 313/113 |
| 2012/0040578 | A1 * | 2/2012 | Anjema et al. | 442/181 |

* cited by examiner

METHOD OF APPLYING A FARADAY CAGE ONTO THE RESONATOR OF A MICROWAVE LIGHT SOURCE

CROSS REFERENCE TO RELATED APPLICATION

This application is for entry into the U.S. National Phase under §371 for International Application No. PCT/GB2011/000163 having an international filing date of February 8, 2011/ and from which priority is claimed under all applicable sections of Title 35 of the United States Code including, but not limited to. Sections 120, 363, and 365(c), and which in turn claims priority under 35 USC 119 to United Kingdom Patent Application No. 1002283.8 filed on February 10, 2010 and to United States Patent Application No. 61/323,987 filed on Apr. 14, 2010.

BACKGROUND OF THE INVENTION

1. Field of the Invention

The present invention relates to a light source for a microwave-powered lamp.

2. Description of the Related Art

It is known to excite a discharge in a capsule with a view to producing light. Typical examples are sodium discharge lamps and fluorescent tube lamps. The latter use mercury vapour, which produces ultraviolet radiation. In turn, this excites fluorescent powder to produce light. Such lamps are more efficient in terms of lumens of light emitted per watt of electricity consumed than tungsten filament lamps. However, they still suffer the disadvantage of requiring electrodes within the capsule. Since these carry the current required for the discharge, they degrade and ultimately fail.

We have developed electrodeless bulb lamps, as shown in our patent application Nos. PCT/GB2006/002018 for a lamp (our "'2018 lamp"), PCT/GB2005/005080 for a bulb for the lamp and PCT/GB2007/001935 for a matching circuit for a microwave-powered lamp. These all relate to lamps operating electrodelessly by use of microwave energy to stimulate light emitting plasma in the bulbs. Earlier proposals involving use of an airwave for coupling the microwave energy into a bulb have been made for instance by Fusion Lighting Corporation as in their U.S. Pat. No. 5,334,913. If an air wave guide is used, the lamp is bulky, because the physical size of the wave guide is a fraction of the wave length of the microwaves in air. This is not a problem for street lighting for instance but renders this type of light unsuitable for many applications. For this reason, our '2018 lamp uses a dielectric wave-guide, which substantially reduces the wave length at the operating frequency of 2.4 Ghz. This lamp is suitable for use in domestic appliances such as rear projection television.

In our International Application No. PCT/GB2008/003829, now published under No. WO 2009/063205, we provide a light source to be powered by microwave energy, the source having:

- a solid plasma crucible of material which is transparent or translucent for exit therefrom, the plasma crucible having a sealed void in the plasma crucible,
- a Faraday cage surrounding the plasma crucible, the cage being at least partially light transmitting for light exit from the plasma crucible, whilst being microwave enclosing,
- a fill in the void of material excitable by microwave energy to form a light emitting plasma therein, and

- an antenna arranged within the plasma crucible for transmitting plasma-inducing microwave energy to the fill, the antenna having:
- a connection extending outside the plasma crucible for coupling to a source of microwave energy;

the arrangement being such that light from a plasma in the void can pass through the plasma crucible and radiate from it via the cage.

As used in that application and this specification:

"lucent" means that the material, of which the item described as lucent, is transparent or translucent;

"plasma crucible" means a closed body enclosing a plasma, the latter being in the void when the latter's fill is excited by microwave energy from the antenna.

SUMMARY OF THE INVENTION

The object of the present invention is to provide an improved method of applying a Faraday cage to a lucent crucible or other resonator of a light source to be powered by microwave energy.

According to the invention there is provided a method of applying a Faraday cage to a lucent resonator, the resonator having a void containing microwave-excitable material and being adapted for microwave resonance in the resonator and within the Faraday cage for driving a light emitting plasma in the void, the method consisting in the steps of:

- deposition of a conductive material on to the lucent resonator;
- applying, patterning and developing a photoresist material over the conductive material to leave the conductive material exposed where it is not required;
- removing the conductive material where not required and the photoresist material from the required conductive material, leaving a reticular network of conductive material providing a Faraday cage and
- depositing a layer of protective material over the cage of conductive material.

Normally the deposited conductive material will be at least twice the skin depth of microwaves to be used in exciting the lucent resonator, and preferably more than three times the skin depth.

Conveniently the conductive material and the protective material are vacuum deposited either by sputtering or by electron-beam evaporation. The conductive material is preferably highly conductive metal such as copper and the protective material is preferably of the same material as the resonator, conveniently quartz, i.e. silicon dioxide, or possibly silicon monoxide.

For fixing the lucent resonator, a ring of the conductive material—either in continuous form or as part of the reticular network—is left uncovered by the protective material and the fixture ring is soldered or brazed to the exposed conductive material.

For directing light from the plasma forwards, a back face of the resonator conveniently has deposited on it a reflective material, forming a continuous extension of the Faraday cage. This can be of the same material as the reticular network, but is preferably of a different material, albeit in conductive contact with it. Conveniently, this reflective material is aluminium.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENTS

Figure 1:
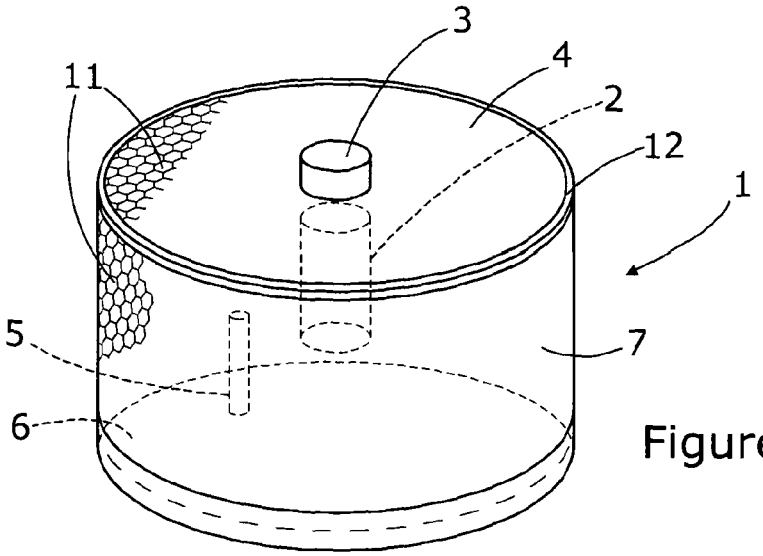
FIG. 1 is a perspective view of a lucent crucible with a Faraday cage applied in accordance with the invention.
Figure 2:
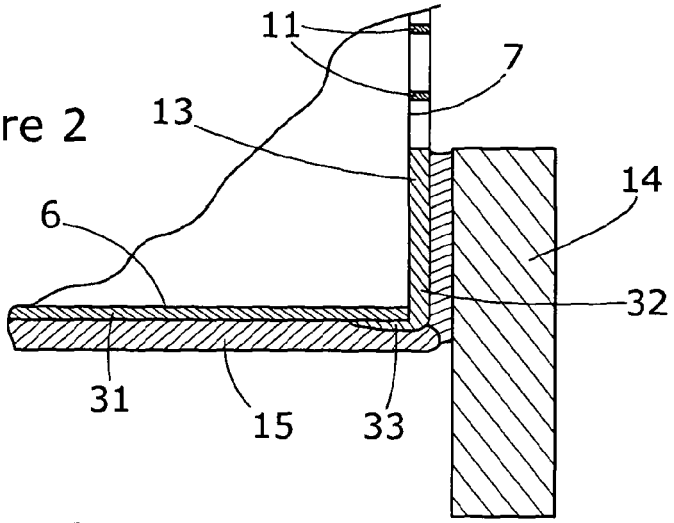
FIG. 2 is a scrap cross-sectional view of a back corner of the crucible showing a fixture ring.
Figure 3:
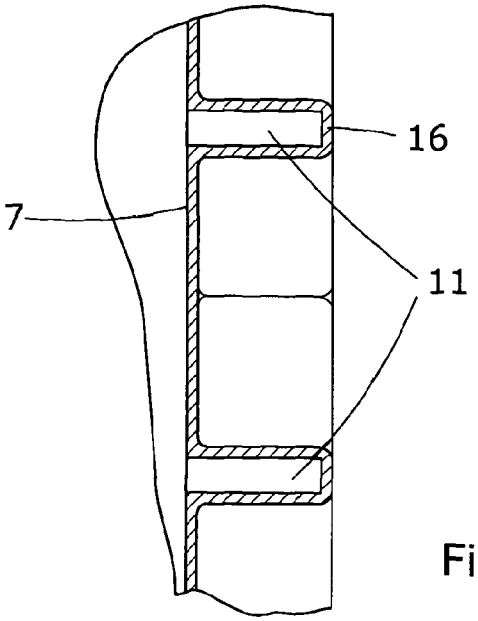
FIG. 3 is a scrap cross-sectional view of the cage showing a protection layer sputtered over the cage.

Referring first to FIGS. 1 to 3 of the accompanying drawings, a lucent crucible 1 is of quartz, being circular and having a diameter of 49 mm and a length of 20 mm. Centrally, it has a void 2, which is 20 mm long and 6 mm in diameter. The diameter could be decreased to as little as 3 mm. A 5 mm long by 10 mm diameter cap 3 closes the void at a front face 4 of the crucible. A metal halide and noble gas charge is contained in the void. An antenna bore 5 is provided from the back face 6 of the crucible and extends into it adjacent the central void.

The crucible has a Faraday cage formed of a hexagonal network 11 of copper lines—50 micron wide by 2 micron thick in the radial direction—covering its circular face 7. The network extends onto the front face 4 and indeed onto the cap 3. A plain line 12 of copper extends around the corner edge between the front face 4 and the circular face 7; and a band 13 of copper extends around the circular cylindrical side-wall adjacent the back face 6. A brass fixture ring 14 is silver soldered to the band 13. The back face is covered in an aluminium layer 15, in electrical contact with the band 13 and the rest of the Faraday cage. Inside the aluminium is a reflective layer 31 enhancing the reflectivity of the aluminium layer. A protective layer 15 of quartz material covers the copper network 11.

Figure 4:
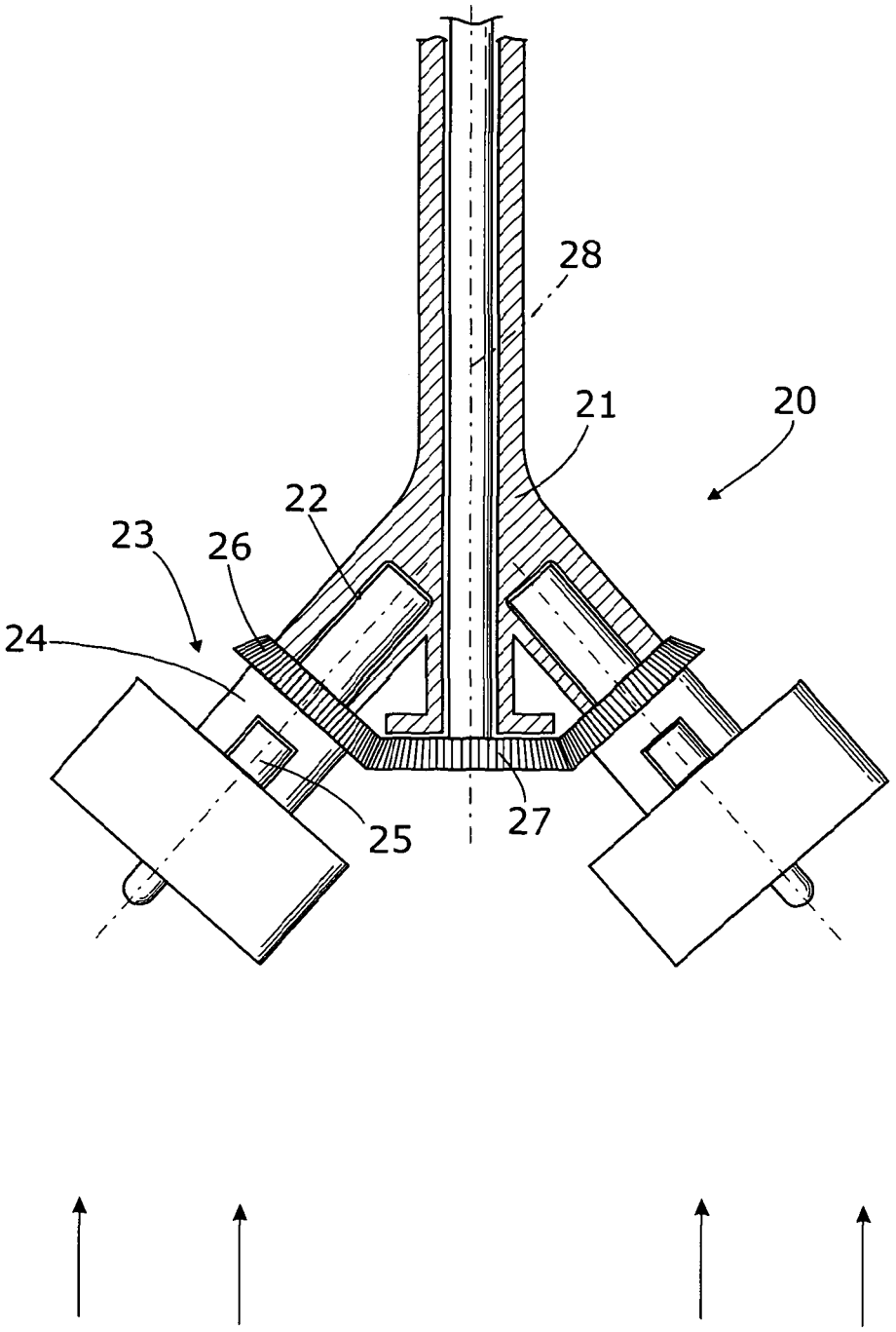
FIG. 4 is a diagrammatic view of a crucible holder for use during sputtering of the front face and sidewall of the crucible.

Application of the Faraday cage to filled plasma crucible will now be described. It should be noted that in practice a plurality of crucibles would be processed together in a batch. For simplicity of explanation, a single crucible only is referred to below:

1. The crucible is cleaned with standard glass cleaning practices to prepare it for metal deposition.
2. The crucible is heated up in a clean furnace to 450° C. to eliminate any surface water vapour.
3. The crucible is immediately loaded into a Sputtering Vacuum Chamber, preferably while still hot. For coating of the rear face of the crucible, it is fixedly mounted with the rear face directed towards an aluminium sputtering target. For coating the front face and the circular cylindrical sidewall, it is mounted obliquely on holder 20 such as shown in FIG. 4. This has a stationary member 21, having 45° angled bores 22 in which are journalled individual holders 23. These have chucks 24 able to grip the crucible via a vestigial sealing tube 25. Mounted with the chucks is a bevel gear 26 in mesh with a complementary gear 27 mounted on a shaft 28, sealingly extending through the member 21. Rotation of the shaft turns the crucible so that its front face and the sidewall are evenly exposed to sputtering as described below.
4. Before sputtering, RF energy @ 13.56 MHz is first applied to an isolated holder retaining the crucibles. This is for the order of 10 seconds, and will clean the crucibles by sputtering off an atomic layer. It will also eliminate any foreign particulate matter or water vapour from the crucible surface.
5. With the crucible set up with its back face exposed, a preliminary optical multi-layer coating 31 is applied to the back face of the crucible for high reflectivity from 400 nm to 800 nm.
6. The crucible is manipulated and mounted at 45° facing a copper sputter electrode. The RF is applied and the deposition process will begin. The deposition rate is on the order of 1 micron per minute, so for a three micron layer the deposition would run for three minutes. Copper 32 is deposited where the mesh is desired, i.e. on the front face and sidewall. Enough of it 33 migrates onto the back face around the edge for electrical contact.
7. The crucible is manipulated again and the RF is then applied to an aluminium sputter electrode and the aluminium coating 15 is applied to the back face, including to the copper rim 33, making electrical contact with it. It should be noted that the aluminium coating has two further functions: (i.) completion of the Faraday cage and (ii.) reflection infra red forwards out of the crucible, to reduce heat transmission towards a source of microwaves exciting the crucible.
8. The crucible is removed after the final deposition and the photoresist is applied. The output front face of the crucible will have the photoresist applied by a spin coater. A blob of photoresist is poured in the centre and then the crucible is spun at high speed. This leaves a very thin and uniform layer over the face. No residual photoresist should drip over the edge and the circular cylindrical side-wall and the back face are still uncoated with resist. The crucible is then put in a special holder and dipped into a container of photoresist just to the top edge, being careful not to let any run over the top onto the thin layer that was applied by the spin on technique. This is not difficult because the photoresist has a very high surface tension and it doesn't run over easily. Once the crucible is lowered into position in the cup so that the resist is at the edge it is then slowly removed at a constant rate. The rate of removal determines the thickness of the photoresist. It is important that the thickness of the resist be uniform or the UV laser source may not expose the resist for the full depth, causing defects.
9. The photoresist covered crucible is then baked in a dark clean oven at 80° C. for 10 minutes.
10. The photoresist is then ready for exposure. A laser galvanometer system is used to write the mesh pattern onto the crucible. The crucible is mounted onto a rotating vacuum fixture and held by the rear aluminium coated surface. The laser galvanometer system then writes the mesh pattern onto the circular cylindrical side-wall, by writing a section and then rotating a set amount and then writing the next section. It takes six such rotations at present. This can be improved with an upgrade to the system, whereby the laser galvanometer moves in the Z axis and the rotation covers the theta rotation for pattern writing. This would be much quicker. While the circular cylindrical side-wall is being written, an additional galvanometer system writes the front face pattern. The side-wall and front face patterns are calibrated so that the lines meet at the edge for continuity. A thin line can be drawn around where the side-wall and front faces meet for additional insurance of continuity from side-wall to the front face.
11. Once exposed the photoresist is immediately developed in KTFR developer solution. This takes two minutes. The unexposed photoresist is washed off in high pressure deionised water. The crucible must immediately be rinsed in alcohol and blown dry with dry nitrogen. The photoresist is no longer light sensitive.

12. The photoresist is now be baked for 20 minutes at 100° C. in a clean oven.

13. After baking the photoresist is ready to etch the pattern where there is no photoresist. The copper quickly etches off in normal copper etchant, such as Ferric Chloride. Some agitation is advantages for uniform etching. This process will take of the order of 30 seconds. It is to be remembered that all of these processes are batch processes, and many crucibles are being processed at once. After etching the crucible is rinsed in flowing de-ionised water.

14. The crucibles are then blown off with dry nitrogen and immersed in photoresist remover for two minutes. Once again, agitation is helpful. After removing from the remover, the crucibles are rinsed in hot soapy water and then de-ionised water. Finally ultrasonically rinsed in isopropyl alcohol and dried with clean dry nitrogen.

15. Once clean, the crucibles are baked at 120° C. and then reloaded into the sputtering chamber. Once again, reverse sputtering is used to remove any residual photoresist and to ensure that the crucibles are free of water and particulate material. A three micron thick layer of SiO2 is then sputtered onto the crucible, covering the copper mesh and the aluminium rear reflector. The chamber crucible holder masks a small ring 13 around the rear edge of the rear reflector, leaving a small strip of copper exposed.

16. A mounting ring 14 is then soldered or brazed to this exposed ring and is used for mounting and electrical connection to the crucible. A quarter wave antireflection layer of MgF could be evaporated over the SiO2 to gain an addition 2-3% output.

The invention claimed is:

1. A method of applying a Faraday cage to a lucent resonator, the resonator having a void containing microwave-excitable material and being adapted for microwave resonance in the resonator and within the Faraday cage for driving a light emitting plasma in the void, the method consisting in the steps of:

deposition of a conductive material onto the lucent resonator;

applying, patterning and developing a photoresist material over the conductive material to leave the conductive material exposed where it is not required;

removing the conductive material where not required and the photoresist material from the required conductive material, leaving a reticular network of conductive material providing a Faraday cage and depositing a layer of protective material over the cage of conductive material wherein a ring of the conductive material, either in continuous form or as part of the reticular network, is left uncovered by the protective material and a fixture ring is soldered or brazed to the exposed conductive material.

2. A method as claimed in claim 1, wherein the conductive material is deposited to a thickness at least twice the skin depth of microwaves to be used in exciting the excitable material and preferably more than three times the skin depth.

3. A method as claimed in claim 1, wherein the conductive material is vacuum deposited either by sputtering or by electron-beam evaporation.

4. A method as claimed in claim 1, wherein the protective material is vacuum deposited either by sputtering or by electron-beam evaporation.

5. A method as claimed in claim 1, wherein the protective material is of the same material as the resonator, preferably quartz, i.e. silicon dioxide, or silicon monoxide.

6. A method as claimed in claim 1, wherein a reflective material, preferably forming a continuous extension of the Faraday cage, is deposited onto a back face of the resonator.

7. A method as claimed in claim 6, wherein the reflective material deposited onto the back face is of the same material as the reticular network.

8. A method as claimed in claim 6, wherein the reflective material deposited onto the back face is of a different material, preferably aluminium.

* * * * *